US006545074B1

(12) United States Patent
Kwon et al.

(10) Patent No.: US 6,545,074 B1
(45) Date of Patent: Apr. 8, 2003

(54) POLYURETHANEURES ELASTIC FIBER, AND A PROCESS OF PREPARING THE SAME

(75) Inventors: Il Cheon Kwon, Kumi (KR); Seok Chul Ryu, Kumi (KR); Hyung Don Huh, Kumi (KR)

(73) Assignee: Kolon Industries, Inc., Kyunggi-Do (KR)

( * ) Notice: Subject to any disclaimer, the term of this patent is extended or adjusted under 35 U.S.C. 154(b) by 28 days.

(21) Appl. No.: 09/720,978

(22) PCT Filed: Jun. 29, 2000

(86) PCT No.: PCT/KR00/00678

§ 371 (c)(1),
(2), (4) Date: Jan. 3, 2001

(87) PCT Pub. No.: WO01/02631

PCT Pub. Date: Jan. 11, 2001

(30) Foreign Application Priority Data

Jul. 2, 1999 (KR) ..... 99-26438
Jun. 28, 2000 (KR) ..... 00-35828

(51) Int. Cl.[7] ..... C08K 5/17
(52) U.S. Cl. ..... 524/236
(58) Field of Search ..... 524/236

(56) References Cited

U.S. PATENT DOCUMENTS

| | | | | | |
|---|---|---|---|---|---|
| 4,504,648 | A | | 3/1985 | Otani et al. | 528/76 |
| 4,548,975 | A | | 10/1985 | Lewis | 524/147 |
| 5,410,009 | A | | 4/1995 | Kato et al. | 528/64 |
| 5,616,676 | A | | 4/1997 | Katsuo | 528/61 |
| 5,644,015 | A | | 7/1997 | Seo et al. | 528/60 |
| 5,879,596 | A | * | 3/1999 | Roach | 264/28 |
| 5,919,564 | A | * | 7/1999 | Sugaya | 428/364 |
| 6,203,901 | B1 | * | 3/2001 | Kosinski | 428/364 |
| 6,245,876 | B1 | * | 6/2001 | Hanahata | 528/61 |

FOREIGN PATENT DOCUMENTS

| | | | |
|---|---|---|---|
| EP | 0579989 A1 | 1/1994 | C08G/18/76 |
| EP | O843032 A1 | 5/1998 | D01F/6/94 |
| JP | 7053776 | 2/1995 | C08K/5/29 |
| JP | 9279014 | 10/1997 | C08L/75/04 |
| KR | 93-11337 | 11/1903 | D01F/6/70 |
| KR | 90-10867 | 2/1992 | D01F/6/10 |
| KR | 96-11609 | 8/1996 | D01F/6/70 |
| KR | 97-7688 | 5/1997 | D01F/6/70 |
| KR | 93-238704 | 10/1997 | D01F/1/10 |

* cited by examiner

*Primary Examiner*—Edward J. Cain

(57) ABSTRACT

This invention relates to a polyurethaneurea elastic fiber of which the weatherability is excellent and the preparing method thereof.

The invention prepares the polyurethaneurea elastic fiber by adding the formamidine type ultraviolet adsorber of the following formula I to the spinning dope and the strength maintenance rate of the polyurethaneurea elastic fiber is over 90% after being leaved for 24 hours at the Fade-O-Meter in which the sunshine carbon arc is installed.

Formula I

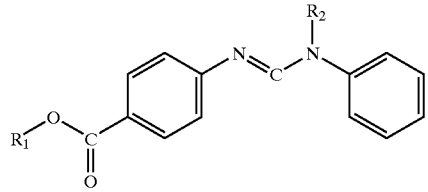

Wherein, R and R represent an each alkyl group of 1 to 5 carbon atoms.

6 Claims, No Drawings

POLYURETHANEURES ELASTIC FIBER, AND A PROCESS OF PREPARING THE SAME

This application claims priority to Republic of Korea Patent Application 1999-26438 filed Jul. 02, 1999; Republic of Korea Patent Application 2000-35828 filed Jun. 28, 2000 and PCT application PCT/KR00/00678 filed Jun. 29, 2000.

TECHNICAL FIELD

This invention relates to a polyurethaneurea elastic fiber which is excellent in the weather resistance, and a process of preparing the same.

BACKGROUND ART

A polyurethane type elastic fiber is excellent in elasticity and elastic recovery so that it has been used widely in a stockings, an underwear for women, a sportswear, a swimming suit and like. However, if the polyurethane type elastic fiber is exposed to the atmosphere, there are problems that the original properties thereof and the orignal color thereof are changed by the sunlight and easily transformed by the waste gas among the atmosphere; and also it is easy to be oxidized by natural outside air so that the original properties are deteriorated.

To complement these faults, Korean Patent Application No. 90-10867 disclosed the method that phenol type antioxidants, amine type ultraviolet stabilizers and methacrylate type yellowing inhibitors are used as additives, but there is a fault that the methacrylate types are weak in heat resistance so as to be exuded and sublimated outward the polymer when it was spun at high temperature to make troubles in processing.

In U.S. Pat. No. 4548975, the method is disclosed that the stabilizing effect to the oxidation and the heat are increased by using a phenol type antioxidant and an phosphite type antioxidant, but there is a fault that the properties and the colors of the urethane type elastic fiber produced are easily changed by the sunshine.

In Korean Patent Publication No. 93-11337, the method is described that an weatherability elastomer is manufactured by using phenol type antioxidant, phosphite type antioxidant, semicarbazide type yellowing inhibitor and benzotriazol type light stabilizer, but there is a problem that the benzotriazol type light stabilizer has little heat resistance and compatibility with the polyurethane elastomer so that it is exuded and sublimated in a spinning process to give a bad effect to the processing.

Korean Patent Application No. 93-28704 describes the method of preparing a chlorine resistance elastic fiber by using inorganic salts, but there is a problem that the technology does not prevent the properties of the elastomer to the light and the heat from deteriorating.

Korean Patent Publication No. 97-7688 describes the composition of using a phenol type antioxidant and a metal salt chlorine resistant, but there is a problem that the method does not prevent the discoloration and the physical properties degradation due to the light.

In Korean Patent Publication No. 96-11609, the resistances to the ultraviolet and the chlorine are promoted by using a benzophenol type light resistant and the inorganic salt chlorine resistant, but there is a problem that the physical properties degradation and the discoloration due to the heat or the waste gas are not prevented.

As described above, many compositions containing various stabilizers to promote the weatherability of a polyurethane type elastomer have been suggested, but there was no technology describing the whole weatherability of light resistance, waste gas resistance, chlorine resistance, oxidation resistance and like; and the method of preparing a polyurethane elastic fiber for the long run under the stable process.

DISCLOSURE OF THE INVENTION

As the invention is designed to solve the above problems, the object of the invention is to provide the method which can produce the polyurethaneurea elastic fiber with the excellent light resistance by using a new type ultraviolet stabilizer under the stable process.

The invention is to provide the polyurethaneurea elastic fiber which is very excellent in light resistance and processing and also maintains its original properties like elasticity as it is, and the preparing method thereof.

The invention relates to a polyurethaneurea elastic fiber which maintains its original properties and is excellent in processing stability and light resistance, and the preparing method thereof.

Particularly, the invention relates to a polyurethaneurea elastic fiber characterized in that the strength maintenance rate thereof after being leaved for 24 hours at the Fade-O-Meter in which the sunshine carbon arc is installed is over 90%.

Also, the invention relates to a polyurethaneurea elastic fiber characterized in that containing the formamidine type ultraviolet adsorber of the following general formula I.

Also, the invention relates to the method of preparing a polyurethaneurea elastic fiber, characterized in that the formamidine type ultraviolet adsorber of the following general formula I is added to the spinning dope.

Formula I

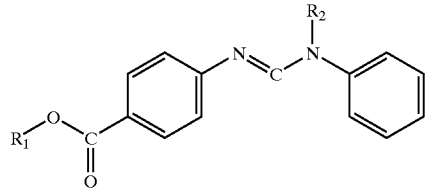

Wherein, $R_1$ and $R_2$ represent each an alkyl group of 1 to 5 carbon atoms.

The invention is characterized in that the formamidine ultraviolet adsorber of formula I is added to the spinning dope in the conventional process of preparing polyurethaneurea elastic fiber.

Hereinafter, the invention will be described in more detail.

First of all, as the conventional polyurethaneurea elastic fiber preparing method, the mixture of diisocyanate compound and the diol compound in a molar ratio of 1.3~2.0 was reacted to yield prepolymer(isocyanate-terminated polyetherurethane), and then the prepolymer was mixed with an appropriate amount of sdvent to provide the solution of prepolymer.

The high molecular weight diol compounds of number average molecular weight 1,500~3,000 are preferably used in prepolymerizing.

Second, diamine compounds and monoamine compounds are added to the above prepolymerization solution, whereby the chains of the prepolymer are extended and/or terminated to produce the polyurethaneurea polymer solution(spinning dope).

At this time, the addition amount of the diamine compounds is preferably 70~99 equivalent weight % of the prepolymer, the addition amount of the monoamine compounds is preferably 1~30 equivalent weight % of the prepolymer. The viscosity of the above polymer solution is preferably regulated to 1,500~5,000 poises at 40° C. for more profitable spinning process.

Next, to the above polyurethaneurea polymer solution (spinning dope), the formamidine type adsorber of the following general formula I is added, and then they are spun to produce the polyurethaneurea elastic fiber according to the invention.

Formula I

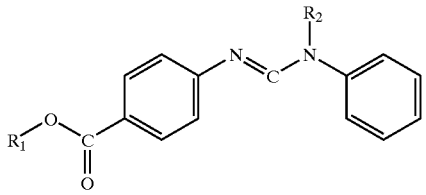

Wherein, $R_1$ and $R_2$ represent each an alkyl group of 1 to 5 carbon atoms.

As specific examples of the formamidine type ultraviolet adsorber of the formula I used in the invention, $N^2$-(4-ethoxycarbonylphenyl)-$N^1$-methyl-$N^1$-phenyl formamidine, $N^2$-(4-methoxycarbonylphenyl)-$N^1$-methyl-$N^1$-phenyl formamidine and $N^2$-(4-ethoxycarbonlyphenyl)-$N^1$-ethyl-$N^1$-phenyl formamidine are included.

The fromamidine type ultraviolet adsorbers of the general formula I are preferably added in the amount of 0.1~3.0 weight %, more preferably 0.5~2.0 weight % to polyurethaneurea polymer(solids). If the amount is below 0.1 weight %, the improving effect of the light resistance of the elastic fiber becomes lowered, if the amount is over 3.0 weight %, the processing of a spinning and like becomes unstable.

The invention includes that to the above polyurethaneurea polymer solution are added the formamidine type ultraviolet adsorber of formula I together with additives such as general antioxidants, chlorine resistants and waste gas resistance stabilizers or pigments such as titanium oxide and like.

As antioxidants, steric-hindered phenol type antioxidants can be mainly used, as chlorine resistants, inorganic salt chlorine resistants like zinc oxide can be used, as waste gas resistance stabilizers, semicarbazide type waste gas resistance stabilizers can be used.

More particularly, to the polyurethaneurea polymer (solids), antioxidant 0.1~1.5 weight %, chlorine resistant 0.1~2.0 weight %, waste gas stabilizer 0.1~2.0 weight %, titanium oxide 0.05~4.0 weight % and blue pigment 0.005~0.002 weight % can be added.

The formamidine ultraviolet adsorber of formula I used in the invention are excellent in heat resistance and ultraviolet protection effect compared to the conventional ultraviolet adsorbers, and it can increase the light resistance and the processing of elastic fiber without deteriorating the original properties of the elastic fiber during the preparing process of the elastic fiber.

The strength maintenance rate of the polyurethaneurea elastic fiber according to the invention is over 90% after being leaved for 24 hours at the Fade-O-Meter in which the sunshine carbon arc is installed.

The polyurethaneurea elastic fiber according to the invention contains the said formamidine type ultraviolet adsorber. The amount of said formamidine type ultraviolet adsorber is 0.5~2.0 weight % to the total weight of polyurethaneurea fiber.

The property test of the polyurethaneurea elastic fiber according to the invention is as follows.

1. Light Resistance Test

The polyurethaneurea elastic fiber of 40 denier was rolled over an aluminium plate and leaved for 24 hours at the Fade-O-Meter in which the sunshine carbon arc was installed, and then the color change(Δb) and the strength maintenance rate before and after treating were measured by the KSK 0700 method.

2. Waste Gas Resistance Test

The polyurethaneurea elastic fiber of 40 denier was rolled over an aluminium plate and treated in the $NO_2$ gas passage of 650 ppm for one hour, and then the color change and the strength maintenance rate before and after treating were measured.

3. Chlorine Resistance Test

The polyurethaneurea elastic fiber was treated in the aqueous solution of chlorine concentration 30 ppm for 5 hours, and then the discoloration and the strength maintenance rate before and after treating were measured.

4. Oxidation Resistance(Heat Resistance) Test

The polyurethaneurea elastic fiber of 40 denier was extended and fixed to the double length thereof, and then heated at 180° C. for 60 seconds. The strength maintenance rate before and after the treatment was measured.

5. Strength Maintenance Rate (SMR %)

Strength Maintenance Rate(%)=(Strength after treating/Strength before treating)×100

BEST MODE FOR CARRYING OUT THE INVENTION

EXAMPLE 1

The mixture of 4,4'-diphenylmethanediisocyanate and the polytetramethyleneetherglycol in a molar ratio of 2.0 was reacted at 90° C. for 90 minutes to give isocyanates terminated polyetherurethane (prepolymer).

After cooling the prepolymer to 40° C., N,N'-dimethylacetamide was added thereto to give the 45% solution containing the prepolymer. The prepolymer solution was cooled to 5° C., and then vigorously stirred with adding slowly the N,N'-dimethylacetamide solution containing ethylenediamine 96 equivalent weight % and diethylamine 6 equivalent weight % to extend and/or terminated the chain thereof for preparing the polyurethaneurea solution.

To the obtained polyurethaneurea solution, 1,3,5-tris (4-t-butyl-3-hydroxy-2,6-dimethylbenzene)-1,3,5-triazine-2,4,6-(1H, 3H, 5H)trion antioxidant 1.2 weight % to the solids of the polyurethaneurea solution, 1,1,1'1'-tetramethyl-4,4'-(methylene-di-p-phenylene) disemicarbazide waste gas stabilizer 1.0 weight %, zinc oxide chlorine resistant 1.2 weight %, $N^2$-(4-ethoxy carbonylphenyl)-$N^1$-methyl-$N^1$-phenylformamidine ultraviolet adsorber 2.0 weight %, titanium oxide 2 weight % and blue pigment(ultramarine blue) 0.003 weight % were added to be spun at 220° C. atmosphere to produce polyurethaneurea elastic fiber of 40 denier. The light resistance, the oxidation resistance(heat resistance), the chlorine resistance and the waste gas resistance of the fiber were estimated to show the following table 1.

EXAMPLE 2

The same method with that of the example 1 except of using the additive $N^2$-(4-ethoxycarbonylphenyl)-$N^1$-methyl-$N^1$-phenylform amidine ultraviolet adsorber 1.5 weight % was used to produce the polyurethaneurea elastic fiber, and then the light resistance, the oxidation resistance(heat resistance), the chlorine resistance and the waste gas resistance of the fiber were estimated to show the following table 1.

EXAMPLE 3

The same method with that of the example 1 except of using the additive $N^2$-(4-ethoxycarbonylphenyl)-$N^1$-methyl- $N^1$-phenylformamidine ultraviolet adsorber 1.0 weight % was used to produce the polyurethaneurea elastic fiber, and then the light resistance, the oxidation resistance(heat resistance), the chlorine resistance and the waste gas resistance of the fiber were estimated to show the following table 1.

EXAMPLE 4

The same method with that of the example 1 except of using the additive $N^2$-(4-ethoxycarbonylphenyl)-$N^1$-methyl-$N^1$-phenylformamidine ultraviolet adsorber 0.5 weight % was used to produce the polyurethaneurea elastic fiber, and then the light resistance, the oxidation resistance(heat resistance), the chlorine resistance and the waste gas resistance of the fiber were estimated to show the following table 1.

Comparative Example 1

The same method with that of the example 1 except of adding no additives to the polymer solution was used to produce the polyurethaneurea elastic fiber, and then the light resistance, the oxidation resistance(heat resistance), the chlorine resistance and the waste gas resistance of the fiber were estimated to show the following table 1.

Comparative Example 2

The same method with that of the example 1 except of adding 1,3,5-tris(4-t-butyl-3-hydroxy-2,6-dimethylbenzene)-1,3,5-triazine -2,4,6-(1H, 3H, 5H)trion antioxidant 0.5 weight % to the polymer solution was used to produce the polyurethaneurea elastic fiber, and then the light resistance, the oxidation resistance(heat resistance), the chlorine resistance and the waste gas resistance of the fiber were estimated to show the following table 1.

Comparative Example 3

The same method with that of the example 1 except of adding 1,3,5-tris(4-t-butyl-3-hydroxy-2,6-dimethylbenzene)-1,3,5-triazine-2,4,6-(1H, 3H, 5H)trion antioxidant 0.5 weight % and zinc oxide chlorine resistant 0.5 weight % to the polymer solution was used to produce the polyurethaneurea elastic fiber, and then the light resistance, the oxidation resistance(heat resistance), the chlorine resistance and the waste gas resistance of the fiber were estimated to show the following table 1.

Comparative Example 4

The same method with that of the example 1 except of adding no $N^2$-(4-ethoxycarbonylphenyl)-$N^1$-methyl-$N^1$-phenylform amidine ultraviolet adsorber to the polymer solution was used to produce the polyurethaneurea elastic fiber, and then the light resistance, the oxidation resistance (heat resistance), the chlorine resistance and the waste gas resistance of the fiber were estimated to show the following table 1.

TABLE 1

| | The result of properties test | | | | | | |
|---|---|---|---|---|---|---|---|
| | Light Resistance | | Oxidation Resistance | Waste gas Resistance | | Chlorine Resistance | |
| Division | Δb | strength maintenance rate (%) | strength maintenance rate (%) | Δb | strength maintenance rate (%) | Δb | strength maintenance rate (%) |
| Ex. 1 | 0.1 | 99.1 | 97.0 | 0.15 | 98.0 | 2.40 | 98.2 |
| Ex. 2 | 0.3 | 98.0 | 95.0 | 0.16 | 98.0 | 2.38 | 98.0 |
| Ex. 3 | 0.4 | 97.3 | 95.0 | 0.16 | 97.3 | 2.38 | 97.6 |
| Ex. 4 | 0.9 | 94.6 | 93.2 | 0.17 | 97.0 | 2.45 | 97.2 |
| Comp. Ex. 1 | 16.3 | 68.9 | 62.3 | 7.2 | 72.1 | 8.9 | 73.8 |
| Comp. Ex. 2 | 14.7 | 69.3 | 82.9 | 7.2 | 73.2 | 8.5 | 73.5 |
| Comp. Ex. 3 | 14.8 | 69.2 | 83.1 | 7.0 | 76.1 | 3.3 | 92.1 |
| Comp. Ex. 4 | 13.9 | 72.1 | 86.1 | 0.56 | 83.9 | 2.92 | 93.1 |

INDUSTRIAL APPLICABILITY

The formamidine type ultraviolet adsorber used in the invention is excellent in the heat resistance and the ultraviolet protection effect so that the polyurethaneurea elastic fiber maintains its original properties like elasticity, simultaneously with being excellent in the weatherability of the light resistance and like.

Besides, the method of the invention can prepare a polyurethaneurea elastic fiber for a long time under the stable process.

What is claimed is:

1. A method of producing a polyurethaneurea elastic fiber, characterized in that the formamidine type ultraviolet adsorber of the following formula 1 is added to the spinning dope, Formula I

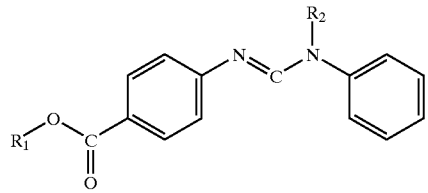

wherein, $R_1$ and $R_2$ represent each an alkyl group of 1 to 5 carbon atoms.

2. A method of preparing a polyurethaneurea elastic fiber as claimed in claim 1, characterized in that said formamidine type ultraviolet adsorber is $N^2$-(4-ethoxycarbonylphenyl)-

$N^1$-methyl-$N^1$-phenylformamidine, $N^2$-(4-methoxycarbonylphenyl)-$N^1$-methyl-$N^1$-phenylformamidine or $N^2$-(1-ethoxylcarbonylphenyl)-$N^1$-ethyl-$N^1$-phenylformamidine.

3. A method of preparing a polyurethaneurea elastic fiber as claimed in claim 1, characterized in that said formamidine type ultraviolet adsorber is added in the amount of 0.1~3.0 weight % to the polyurethaneurea polymer(solids).

4. A method of preparing a polyurethaneurea elastic fiber as claimed in claim 1, characterized in that said formamidine type ultraviolet adsorber is added in the amount of 0.5~2.0 weight % to the polyurethaneurea polymer(solids).

5. A polyurethaneurea elastic fiber, characterized in containing the formamidine type ultraviolet adsorber of the following formula I.

Formula I

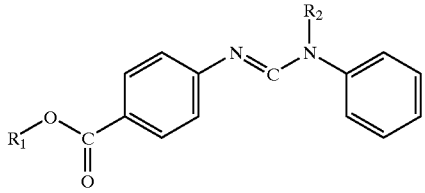

wherein, $R_1$ and $R_2$ represent each an alkyl group of 1 to 5 carbon atoms.

6. A polyurethaneurea elastic fiber as claimed in claim 5, characterized in that the amount of said formamidine type ultraviolet adsorber is 0.5~2.0 weight % to the total weight of the polyurethaneurea fiber.

* * * * *

UNITED STATES PATENT AND TRADEMARK OFFICE

CERTIFICATE OF CORRECTION

PATENT NO. : 6,545,074 B1
DATED : April 8, 2003
INVENTOR(S) : Kwon et al.

It is certified that error appears in the above-identified patent and that said Letters Patent is hereby corrected as shown below:

Title page, Item [54] and Column 1, line 1,
delete "POLYURETHANEURES" and insert -- POLYURETHANEUREA --

Signed and Sealed this

Fifth Day of August, 2003

JAMES E. ROGAN
*Director of the United States Patent and Trademark Office*